US009683384B2

(12) United States Patent
Gerrard et al.

(10) Patent No.: US 9,683,384 B2
(45) Date of Patent: Jun. 20, 2017

(54) SURFACE MOUNT POST AND POST RETAINING SYSTEM

(71) Applicants: Robert Gerrard, Coventry (GB); Marcus Gerrard, Coventry (GB)

(72) Inventors: Robert Gerrard, Coventry (GB); Marcus Gerrard, Coventry (GB)

( * ) Notice: Subject to any disclaimer, the term of this patent is extended or adjusted under 35 U.S.C. 154(b) by 38 days.

(21) Appl. No.: 14/833,772

(22) Filed: Aug. 24, 2015

(65) Prior Publication Data

US 2016/0076208 A1 Mar. 17, 2016

(30) Foreign Application Priority Data

Sep. 17, 2014 (GB) ..... 1416388.5

(51) Int. Cl.

| | |
|---|---|
| ***E04H 12/22*** | (2006.01) |
| ***E01F 13/02*** | (2006.01) |
| ***E01F 13/12*** | (2006.01) |
| ***E01F 9/529*** | (2016.01) |

(52) U.S. Cl.

CPC ..... *E04H 12/2238* (2013.01); *E01F 9/529* (2016.02); *E01F 13/026* (2013.01); *E01F 13/12* (2013.01)

(58) Field of Classification Search

CPC ..... E01F 15/00; E01F 15/003; E01F 9/011; E01F 9/0117; E01F 13/12; E04H 6/42; E02D 27/42; E02D 27/50

See application file for complete search history.

(56) References Cited

U.S. PATENT DOCUMENTS

| | | | | |
|---|---|---|---|---|
| 3,193,230 A * | 7/1965 | Crankshaw | ..... | E01F 9/627 248/160 |
| 4,605,336 A | 8/1986 | Slaw, Jr. | | |
| 5,520,479 A * | 5/1996 | Hernandez | ..... | E01F 13/026 256/13.1 |
| 6,409,419 B1 * | 6/2002 | Hernandez | ..... | E01F 13/04 404/6 |

(Continued)

FOREIGN PATENT DOCUMENTS

| | | |
|---|---|---|
| GB | 2511273 A | 9/2014 |
| JP | H08100537 A | 4/1996 |

OTHER PUBLICATIONS

Combined Search and Examination Report for Application No. GB1416388.5 dated Mar. 2, 2015.

*Primary Examiner* — Abigail A Risic

(74) *Attorney, Agent, or Firm* — Levenfeld Pearlstein, LLC

(57) ABSTRACT

A surface mount barrier post and assembly method has a retaining system to receive the post. The retaining system includes a post retaining element for receiving the post. The retaining element has a substantially vertical hollow steel section having an opening at its lower end on a first side, a steel foot box aligned with the opening and extending in a first direction, and a bottom plate to which the hollow section and foot box are attached. A steel front traverse member passes over the foot box and lies adjacent the bottom plate perpendicular the first direction. A steel rear traverse member lies adjacent the vertical hollow section on a second side opposite substantially perpendicular to the first direction. U-bolts are arranged to pass over the front and rear members on either side of the retaining element for receipt into holes in a surface on which the retaining system is mounted.

20 Claims, 8 Drawing Sheets

(56) References Cited

U.S. PATENT DOCUMENTS

| | | | | |
|---|---|---|---|---|
| 2002/0166302 | A1* | 11/2002 | Ogorchock | E02D 27/42<br>52/294 |
| 2009/0208285 | A1* | 8/2009 | Adler | E01F 13/00<br>404/6 |
| 2011/0293366 | A1* | 12/2011 | Gerrard | E01F 15/0476<br>404/6 |
| 2014/0102025 | A1* | 4/2014 | Cariaga | E02D 27/02<br>52/299 |

* cited by examiner

S101 – Provide a kit of parts comprising: a post retaining element; a front traverse member; a rear traverse member; a left and right side member, rebar reinforcement, an impact post and packing element

↓

S102 – Locate template in desired location and drill holes

↓

S103 – Assemble the a post retaining element; a front traverse member; a rear traverse member; a left and right side member on a solid surface as shown in Figures 1 and 2

↓

S104 – At least partially fill the holes with one of grout, a concrete or a bolt setting compound.

↓

S105 – Locate the U-bolts such that they pass over the front and rear traverse members and the side members and push into the at least partially filled holes

↓

S106 – Form a rebar grid over the impact facing end of the post retaining element and left and right traverse members

↓

S107 - Encapsulate the post retaining element, said vertical hollow steel section, said traverse members, and said plurality of U-bolts in concrete substantially up to the top of said vertical hollow section.

↓

S108 – Locate a first spring steel element of the impact post in the post retaining element and slide it forwards so that a substantially horizontal section thereof extends into said foot box.

↓

S109 - Locate any further impact post spring steel elements in the post retaining element

↓

S110 – Locate the packing element in the post retaining element adjacent the impact post.

Figure 13

SURFACE MOUNT POST AND POST RETAINING SYSTEM

BACKGROUND

The present disclosure relates to a post that acts as a barrier to impede the passage of a vehicle. In particular the present disclosure relates to a surface mounted post, a method of constructing such a post and a kit of parts for such a post.

Security barriers, or crash barriers, the main purpose of which being to prevent the passage of vehicles, are widely known in the art and have many applications. Common applications are for bordering dangerous sections of roads, providing a central separation between lanes of traffic moving in opposite directions and around secure areas, for example around the entrance to airports or the like.

Known security barriers are generally made of metals, in particular steel, and comprise a post, which is bedded in concrete, to which a barrier is attached. To provide the structural integrity to stop a car moving at around 40 to 50 km/h such barriers need a very deep reinforced bedding of around a meter in depth and, for larger trucks a bedding of up to two meters, into which the posts are set, is needed. As well as the obvious disadvantages in terms of the amount of material needed and the increased complexity of excavating to the required depth, the necessity of burying the posts to such a depth often interferes with existing buried services, for example electricity cables and sewage or water pipes. Although many are marked and can be anticipated during the planning stage, the discovery of pipes during deep excavation is common and necessitates halting excavation until the nature of the pipe/cable has been ascertained. A solution to these problems having a shallow footing of as little as 200 mm is presented in WO2013/136042.

In multi-level parking structures associated with air ports, shopping malls, or even with individual stores, for shopper convenience there is often access to the mall or store from higher levels of the parking structure. Such access is often quite large, often large enough to drive a vehicle through. As security at the main road access of airports, shopping malls, etc. is improved these parking structure entrances become a weak point in vehicular penetration during potential terrorist activities, or the like.

In such locations the thickness of the concrete floor of the parking structure in often in the region of 200 mm to 350 mm deep and setting such a barrier as disclosed in WO2013/136042 is impractical for two reasons. Firstly, unless installed when the original concrete is laid, it will be required to break a hole in the concrete which given its depth is not significantly deeper than the hole that would need to be dug is not a practical solution. Secondly the lower parts of the buried footing will be very close to the base of the concrete floor and as such there is a risk of "punch through" o the post when subjected to an impact creating a hazardous situation for anyone on the level beneath.

Some surface mounted security barriers have been proposed however these have a number of problems associated therewith. One solution is offered by ATG Access Limited which requires large heavy sections of barrier to be laid out across a long length. Under impact the sections move and absorb the impact across the large sections so only a small amount of the impact force is placed upon the end anchors. While this solution may have some application in larger spaces they are impractical in the above mentioned situation where there is simply not the space available to use such a system, or where only a small length of barrier, e.g. three metres, is required.

Another system is provided by RSA Protective Technologies, LLC. In this system a plurality of large barrier sections are attached to one another and large concrete end blocks each in the region of five cubic metres are placed at either end.

A further system is the provided by Heald Ltd. This product large prefabricated barrier sections are attached to a concrete surface by drilling and bolting through a large number of holes located on a flange around the edge of the sections. Although such a design may have uses, under large impact the bolts will have a tendency to shear as the flange exerts sideways pressure thereon.

All of the above systems suffer in the size and weight of the component parts. In particular they are not suitable to be retro fit into a parking structure. In particular such structures often have low access openings as ceiling height is often limited to increase the number of levels of parking available within as structure so as to ensure high paring space density Such designs often make it impossible for the size of vehicle with their associated required lifting gear needed to deliver and install such systems.

It is a further disadvantage of these above existing products that if intermittent or occasional access is required the whole installation process must be reversed, and subsequently re-performed, to allow vehicular access past the barrier which is a time consuming and costly process. Known retractable or removable bollards all require a substantive depth of surface (certainly more that is available in multi-level parking structures) to allow for the bollards to be securely retained.

There is therefore a need for an improved security post and installation method that mitigates at least some of the above mentioned problems.

SUMMARY

Aspects of the present disclosure relate to a surface mount barrier post retaining system, a security barrier, a kit of parts or a method for installing one of the above.

According to a first aspect of the disclosure, there is provided a surface mount barrier post retaining system comprising: a post retaining element for receiving an impact post, the post retaining element comprising a substantially vertical hollow steel section having an opening at its lower end on a first side thereof, said first side comprising a side which, in use, faces a direction of impact protection; a steel foot box aligned with said opening and extending therefrom in a first direction; and a bottom plate to which said hollow steel section and said foot box are attached; a steel front traverse member that lies at least partially adjacent the bottom plate and substantially perpendicular to said first direction, the traverse member formed to pass over the steel foot box; a steel rear traverse member that lies adjacent the vertical hollow steel section on a side thereof opposite the foot box and substantially perpendicular to said first direction; wherein the front traverse member and the rear traverse member extend to the lateral sides of the vertical hollow steel section; and a plurality of U-bolts, said U-bolts arranged to pass over the front and rear traverse members on either side of the post retaining element to, in use, be received and set into a plurality of holes drilled into a surface on which the barrier post retaining system is mounted.

The term direction of impact protection as used herein will be understood to mean the direction from which, in use a threat of impact is anticipated to originate. The term front will be understood to be the side towards which in use a threat of impact is anticipated to originate and the term rear will be understood to be the side away from which in use a threat of impact is anticipated to originate.

The vertical hollow steel section may have a substantially rectangular cross section, for example it may comprise a section of rectangular box section.

The front and rear traverse members may be spring steel members. By using spring steel, energy is dissipated from the spring steel member into the concrete on which it is set and surrounded by along its length, rather than bending past its yield point an the point of impact and imparting point loading onto the concrete.

The system may comprise at least one support plate extending substantially vertically from the bottom plate and abutting a rear facing side of the vertical hollow section, each said at least one support plate having a recess in its upper edge for receiving said rear traverse member therein. Preferably, when located in said recess, the said at least one support plate the rear traverse member is maintained in spaced relation from said bottom plate. The support plate assists in dissipating force downwards into the base plate.

The bottom plate may comprise two openings therein, the system further comprising a U-bolt passing over said at least one support plate and through said openings in the bottom plate to, in use, be received and set into holes drilled into said surface on which the barrier post retaining system is mounted, and wherein said openings in the bottom plate are elongate in said first direction.

By being elongate in the direction of impact, under impact, as the bottom plate does not directly abut the U-bolts, shear force imparted on the bolts at the instant of impact is reduced.

On one arrangement the system may further comprise at least one left and at least one right spring steel member each extending, in use, along the surface on which the system is mounted, each of the left and right members passing beneath the rear member and passing over the front member substantially perpendicular thereto in a position offset from the bottom plate; and wherein said plurality of U-bolts are further arranged to pass over the left and right spring steel members at or adjacent either end thereof to, in use, be received and set into said plurality of holes. These left and right spring steel members assist the retention of the system in that they assist in preventing the front of the retaining system from lifting under large impact and spread the retention over a larger number of U-bolts over a larger area.

Preferably in the system the internal width of the U-bolts is greater than the external dimension of the member over which they pass such that there is a clearance therebetween. The clearance may be in the region of 5 mm to 25 mm on each side. By providing a clearance there is no direct shear force exerted on the bolts by the members under impact, i.e. a small shift in the base plate or the spring steel members will not result in them bearing directly on the U-bolt.

The system may further comprising a concrete surface on which the system is mounted, the concrete surface having a plurality of holes therein in which the U-bolts are retained and set using a cross-linking compound. The cross linking compound could be, for example, a concrete or grout based product or a bolt setting compound, for example Vitrobond® from Atlas Minerals and Chemicals, Inc.

Preferably the system further comprises a concrete encapsulation covering: said retaining element substantially up to the top of said vertical hollow steel section, said traverse members, and said plurality of U-bolts.

The concrete encapsulation may also substantially cover the left and right spring steel members. The concrete will fill the spaces between the U-bolts and the members and bottom plate over which they are located. Under impact the concrete in these regions will spread the load from the impact into the U-bolts. As the concrete will undergo some crushing the duration of the impact is increased, i.e. the impact load is spread over a longer time period due to some movement as the concrete crushes, thereby reducing maximum instantaneous force. In addition, as the front and rear traverse members are not immediately adjacent the surface on which the system is mounted (as they sit on top of the bottom plate which has a thickness) the forces acing on both legs of each U-bolt is a turning moment as opposed to a shear force as the force acts at a position offset from attachment of the U-bolts into the surface.

Optionally the concrete encapsulation may include steel, e.g. rebar, reinforcement. For example a plurality of perpendicularly arranged rebar rods may be to the front of the vertical hollow section.

According to a further aspect of the disclosure there is provided a security barrier comprising: a surface mount barrier post retaining system as described above, an impact post extending into said vertical hollow steel section and comprising at least a first spring steel element comprising a substantially vertical section and a substantially horizontal section, and at least one packing element; wherein said at least one packing element is located in said vertical hollow steel section behind said impact post to retain it in a position in which said horizontal section thereof extends into said foot box.

The impact post may further comprise at least one further vertical spring steel section adjacent said first spring steel element, said further spring steel section having one end thereof extending into the vertical hollow section between said first spring steel element and said packing element According to another aspect of the disclosure there is provided a kit of parts for a surface mount barrier post retaining system which when assembled forms the surface mount barrier post retaining system as described above, the kit of parts comprising: a post retaining element for receiving an impact post, the post retaining element comprising a substantially vertical hollow steel section having an opening at its lower end; a steel foot box aligned with said opening and extending therefrom in a first direction; and a bottom plate to which said hollow steel section and said foot box are attached; a first elongate steel member having a formation therein to, when assembled, pass over the steel foot box, the first steel elongate member on assembly forming the front traverse member; and a second elongate steel member which, on assembly forms the rear traverse member; and a plurality of U-bolts.

Preferably the first and second elongate steel members comprise spring steel.

The post retaining element may further comprise at least one support plate extending substantially vertically from the bottom plate and abutting a rear facing side of the vertical hollow section, each said at least one support plate having a recess in its upper edge for, on assembly, receiving said rear traverse member therein.

The bottom plate may comprise two openings therein for, on assembly, receiving a U-bolt passing over said at least one support plate and through said openings, and wherein said openings are elongate in the first direction.

The kit of parts may additionally comprise two further spring steel member which on assembly extend along the surface on which the system is mounted, each of said two further spring steel members passing beneath the second elongate member and shaped to pass over the first elongate member substantially perpendicular thereto in a position offset from the bottom plate; and a plurality of U-bolts for on assembly passing over one of said two further spring steel members at or adjacent either end thereof.

The kit of parts may further comprising a drilling template comprising a planar template having drilling locations thereon. The template maybe a steel sheet and the drilling locations may be provided as holes in the sheet.

According yet a further aspect of the disclosure there is provided a kit of parts for a security barrier which when assembled forms the barrier as described above, the kit of parts comprising: a kit of parts as described above; an impact post extending into said vertical hollow steel section and comprising at least a first spring steel element comprising a substantially vertical section and a substantially horizontal section; and at least one packing element.

The kit of parts may further comprise at least one further vertical spring steel section for on assembly having one end thereof extending into the vertical hollow section between said first spring steel element and said packing element.

According to another aspect of the disclosure there is provided a method of constructing a surface mount barrier post retaining system comprising: drilling a plurality of holes in said concrete surface; assembling a surface mount barrier post retaining system according as described above on a concrete surface such that the traverse members are adjacent and between drilled holes; locating a plurality of U-bolts such that they pass over the front and rear traverse members on either side of the post retaining element and into said drilled holes; and securing said U-bolts in said holes using one of grout, a concrete or a bolt setting compound.

The method may further comprising encapsulating said retaining element, said vertical hollow steel section, said traverse members, and said plurality of U-bolts in concrete substantially up to the top of said vertical hollow section. By encapsulating it will be understood that the said retaining element, said vertical hollow steel section, said traverse members, and said plurality of U-bolts are surrounded by concrete that extends up to both not over the top of the vertical hollow section, i.e. the top of the vertical hollow section is above the level of the concrete so as to be able to receive a post therein.

The method may further comprise: locating a spring steel impact post such that it extends into said vertical hollow steel section, the impact post having a substantially vertical section and a substantially horizontal section, and locating at least one packing element in said vertical hollow steel section behind said impact post to retain it in a position in which said horizontal section thereof extends into said foot box. It will be appreciated that as the impact post, i.e. the part of the post that extends upwards from the retaining system is slotted into place and retained with the packing element, that in the event that after installation occasional vehicular access is required past the barrier then by removing the packing element the impact post can be slid away from the foot box and lifted vertically out of the retaining system to leave the retaining system encased in concrete which the vehicle can driver over at a low speed, i.e. with the impact post removed the remaining structure of the barrier forms a "speed bump" that will allow vehicular passage at a low speed.

This removable nature is particularly advantageous where there is a requirement to have a security barrier, but where occasional deliveries (into a central atrium of an upper level of a shopping mall, for example) may be occasionally required.

The method may further comprise locating at least one further vertical spring steel section adjacent to said spring steel impact post such that one end of said vertical further spring steel section extends into the vertical hollow section between said first spring steel element and said packing element.

Within the scope of the appended claims it is expressly envisaged that the various aspects, embodiments, examples and alternatives set out in the preceding paragraphs, and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

One or more embodiments of the will now be described, by way of example only, with reference to the accompanying drawings, in which, in an embodiment:

FIG. 13 shows a flow diagram of an embodiment of the method.

DETAILED DESCRIPTION

A surface mount barrier post retaining system, a surface mount security barrier and a method of installing such retaining systems and security barriers in accordance with the various aspects of the disclosure are described herein with reference to the accompanying Figures.

Figure 1:
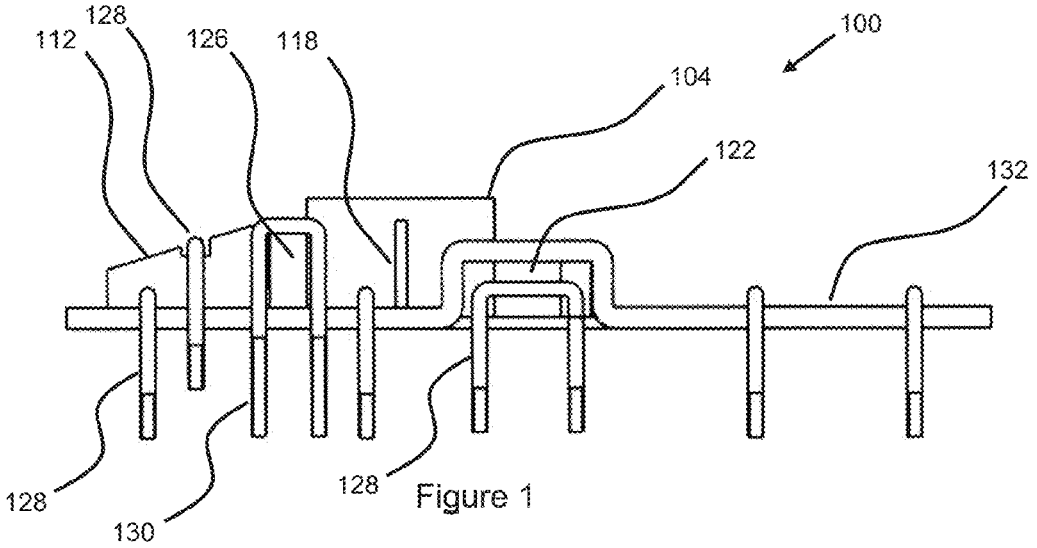
FIG. 1 shows a side view of a surface mount barrier post retaining system.
Figure 2:
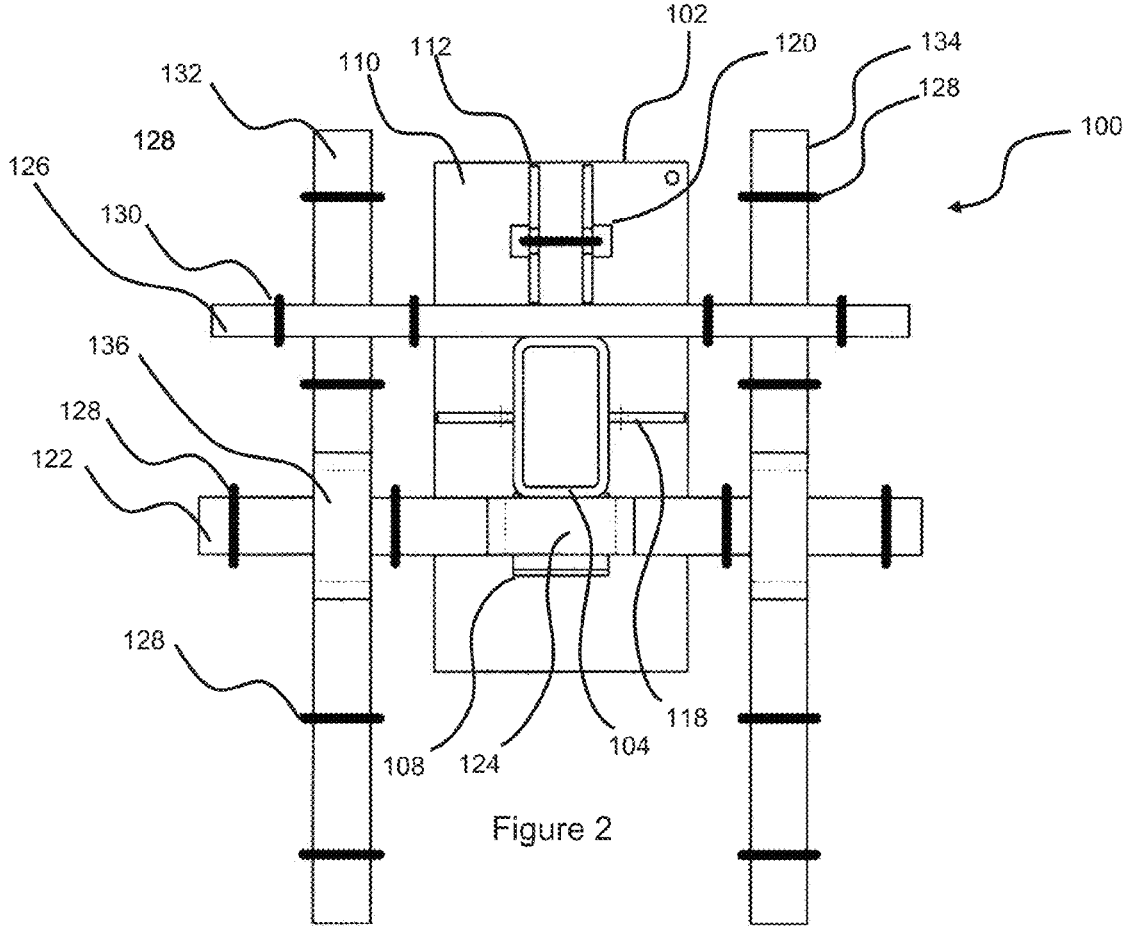
FIG. 2 shows top view of the surface mount barrier post retaining system of FIG. 1.
Figure 3:
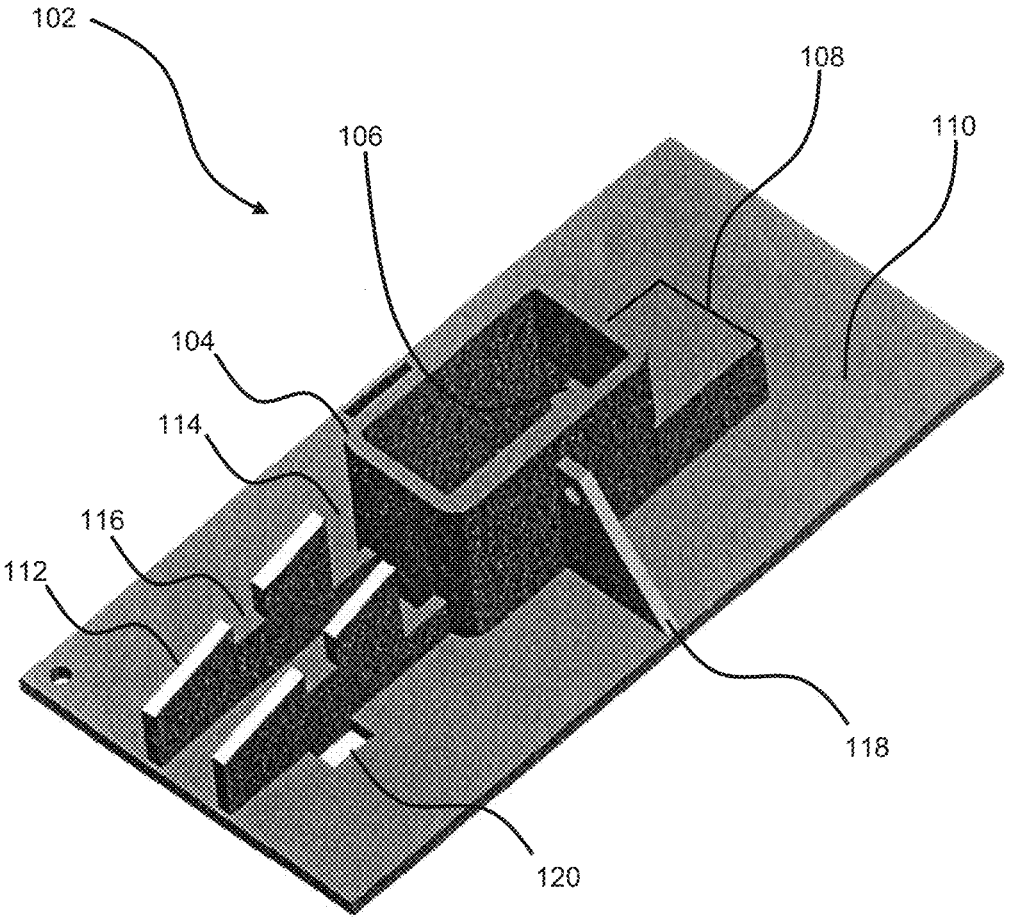
FIG. 3 shows a perspective view of the post retaining element of the surface mount barrier post retaining system.

With reference to FIGS. 1 to 3, a surface mount barrier post retaining system 100 is shown. The surface mount barrier post retaining system 100 comprises a post retaining element 102 which is shown in detail in FIG. 3. The post retaining element 102 comprises a substantially vertical hollow steel section 104 having an opening 106 at its lower end on side facing a direction of impact protection. The substantially vertical hollow steel section may for example comprise a section of rectangular steel box section.

The term direction of impact protection as used herein will be understood to mean the direction from which, in use a threat of impact is anticipated to originate. The term front will be understood to be the side towards which in use a threat of impact is anticipated to originate and the term rear will be understood to be the side away from which in use a threat of impact is anticipated to originate. Where protection is required by the use of barrier posts the post will generally be placed between the asset that they are designed to protect, for example a building or facility, and a direction from which a perceived threat is likely to originate.

A steel foot box 108 is aligned with the opening 106 in the substantially vertical hollow steel section 104. Both the substantially vertical hollow steel section 104 and the steel foot box 108 are attached to a bottom plate 110 which extends from them on all sides.

A pair of support plates 112 is provided which extend substantially vertically from the bottom plate 110 and abut a rear facing side of the vertical hollow section 104. Each support plate has a pair of first and second recesses 114, 116 its upper edge, the purpose of which is described in detail below. A pair of openings 120 is provided in the bottom plate 110 adjacent the second recesses. Additional support members 118 are provided which extend between the bottom plate 110 and the side of the substantially vertical hollow steel section 104. The substantially vertical hollow steel section 104, the foot box 108 and the support plates 112, and support members 118 are welded to the bottom plate 110 so as to form the post retaining element 102 as a single component.

In an example, the post retaining element 102 has overall dimensions of 800 mm×400 mm×175 mm high and may weigh in the region of 63 Kg, i.e. it is of a size and weight that can be easily lifted and maneuvered without the need for heavy plant.

The surface mount barrier post retaining system 100 further comprises steel front traverse member 122 configured to lie adjacent the bottom plate 110 and substantially abutting the substantially vertical hollow steel section 104 such that it is perpendicular to a direction of impact protection. The front traverse member 122 is bent in its centre 124 such that it is formed to pass over the steel foot box 108. The front traverse member 122 is ideally provided as a separate component from the post retaining element 102 not permanently attached thereto, although other arrangements may be useful. The front traverse member 122 is formed of spring steel and in an exemplary embodiment is 1140 mm long and has a cross section of 100 mm×28 mm.

In addition to the steel front traverse member 122 the surface mount barrier post retaining system 100 also has a steel rear traverse member 126 which is configured to lie adjacent a side of the vertical hollow steel section 104 opposite the foot box 108 and in a direction substantially perpendicular to a direction of impact protection. The rear traverse member 126 comprises a substantially straight section of spring steel which in the exemplary embodiment is 1100 mm long and has a cross section of 100 mm×50 mm. The rear traverse member 126 locates in the recesses 114 provided in the support plates 112 and enable force to be transmitted from the vertical hollow steel section 104 into the bottom plate 110 via the support plates 112. The recesses 114 are dimensioned so as to retain the rear traverse member 126 in spaced relation to the bottom plate 110. When positioned both the front traverse member 122 and the rear traverse member 126 extend to both sides of the vertical tubular steel section 104, and as can be seen in FIG. 2, extend beyond the edges of the bottom plate 108.

A plurality of U-bolts 128, 130 also form a part of the surface mount barrier post retaining system 100. The U-bolts 128 pass over the front traverse member 122 at four locations, two on either side of the bottom plate 110, and have an internal height of 175 mm, an internal width of 110 mm and a M20 thread, 125 mm long. As they have an internal dimension that is greater than the width of the front traverse member 122 they have a clearance on either side thereof of approximately 5 mm, although other clearances may be useful, for example clearances in the range of 2 mm to 20 mm. A U-bolt 128 of the same dimension passes over the support plates 112, locates in the second recesses 116 in the upper edge thereof, and extends through the openings 120 in the bottom plate 110. The openings 120 are dimensioned to have a clearance around the U-bolts and are elongated in the direction of impact to form short slots The U-bolts 130 pass over the rear traverse member 126 at four locations, two on either side of the bottom plate 110, and have an internal height of 284 mm, an internal width of 60 mm and a M20 thread, 125 mm long. As they have an internal dimension that is greater than the width of the rear traverse member 126 they have a clearance on either side thereof of approximately 5 mm, although other clearances may be useful, for example clearances in the range of 2 mm to 20 mm. In use the U-bolts 128, 130 are set into a hard surface, for example a concrete floor, on which the barrier post retaining system 100 is mounted.

For further improved impact durability the surface mount barrier post retaining system 100 can optionally also include a left 132 and a right 134 steel member each of which are positioned to extend along the surface on which the system 100 is mounted. The left and right members are 1140 mm long and have a cross section of 100 mm×28 mm.

Each of the left and right members 132, 134 passes beneath the rear traverse member 126 and is formed, substantially in its centre 136 to pass over the front traverse member 122 substantially perpendicular thereto in a position offset from the bottom plate 110. Each of the left and right members 132, 134 are secured to the surface that the system is mounted on by four U-bolts 128 as described above. A U-bolt pass over the left and right spring steel members at or adjacent each end thereof, and a further U-bolt passes over each end of the left and right spring steel member towards the centres thereof. The U-bolts are received and set into a plurality of holes drilled into a surface on which the barrier post retaining system is mounted. As described above the dimensions of the U-bolts 128 is such that their internal width is greater than the external dimension of the left and right member over which they pass such that there is a clearance therebetween.

Figure 11:
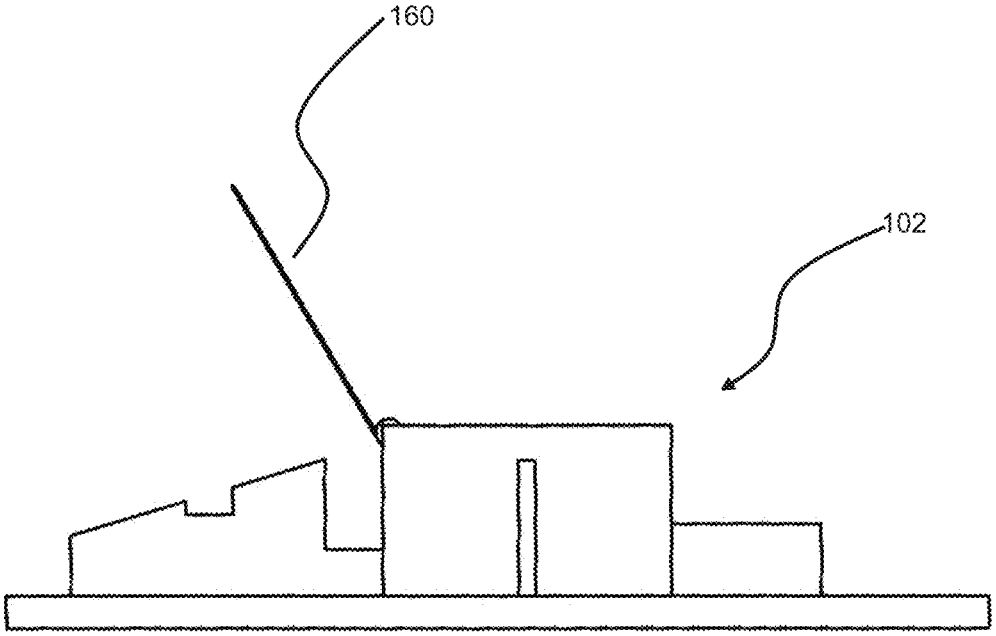
FIG. 11 shows an alternative post retaining element for use in the system of FIG. 1.

Referring to FIG. 11 an alternative post retaining element 102*a* is shown. The post retaining element 102*a* is identical to the post retaining element 102 shown in FIG. 1 except in so far as it further includes a lid 160, pivotally attached to the top rear edge of the substantially vertical hollow steel section 104. The lid 160 can pivot upwards to allow the impact post 148 to be inserted into the substantially vertical hollow steel section 104. When the impact post 148 is removed the lid 160 can be pivoted downwards to close over the opening in the top of the substantially vertical hollow steel section 104. This will enable, for example, pedestrians to walk over the ramp formed by the concrete 142 without danger of their foot getting trapped by the cavity formed by the substantially vertical hollow steel section 104, thereby providing a flush upper surface when the impact post 148 is removed.

Figure 12:
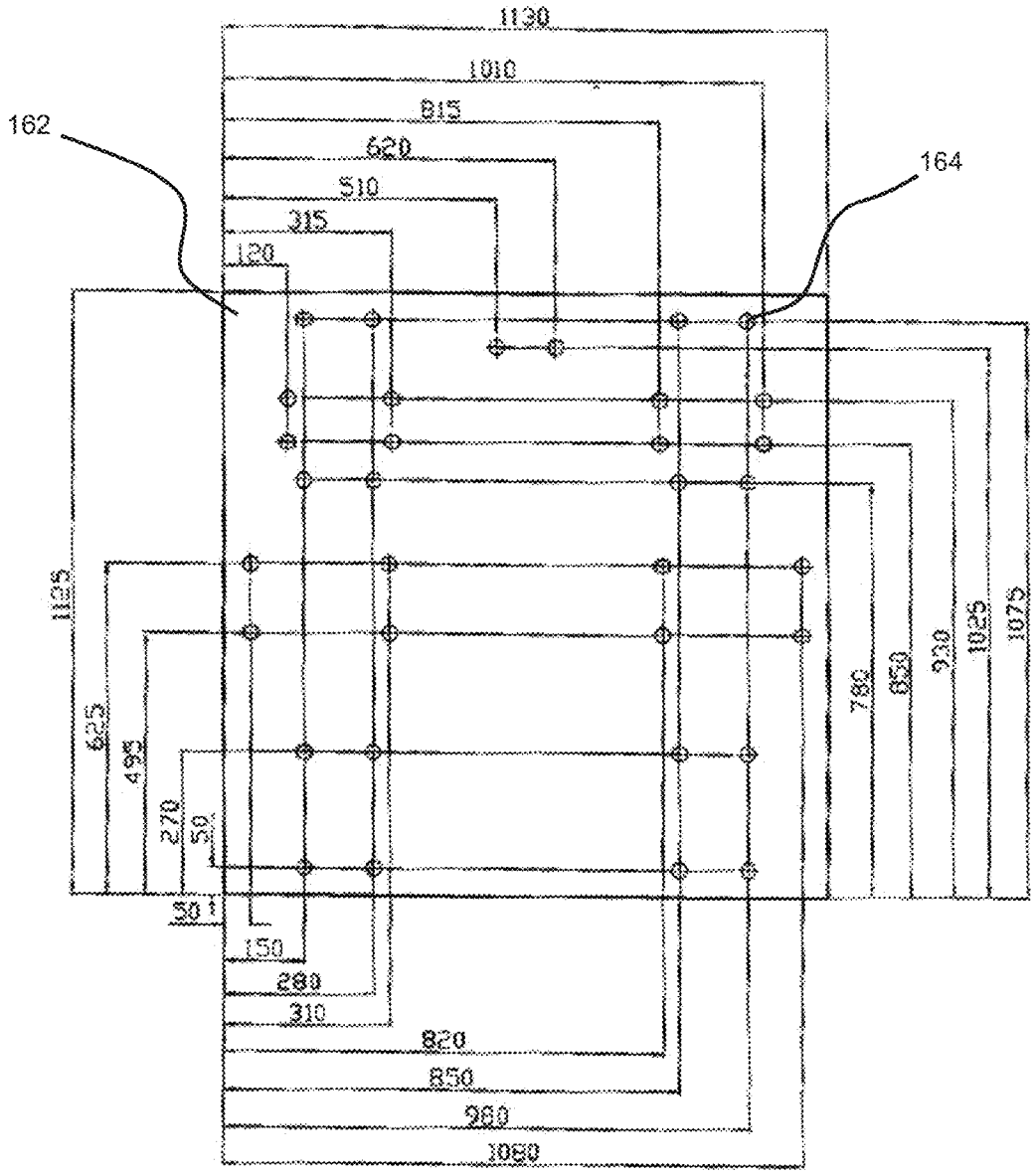
FIG. 12 shows a drilling template for use in installation of the a surface mount barrier post retaining system of FIG. 1.

Referring to FIG. 12 a drilling template 162 is shown. The template is used for locating the holes which need to be drilled to receive the U bolts as described above. The template is preferably made of a durable material, for example a mild steel plate, and has holes 164 therein corresponding to the required drilling locations. It will be appreciated that the dimensions given are an exemplary embodiment only and the locations of the drilling holes on the template may vary depending on the size of the post and impact it is intended to stop. In FIG. 12 the dimensions of the hole locations are given in mm. In use the template may either be placed on the surface on which the system is to be installed and paint sprayed through the holes to mark the drilling locations, or the holes may be drilled directly through the template. Accordingly the holes in the template will be larger than the drill size, for example the drill size may be 25 m and the template holes may be 28 mm in diameter. Optionally a plurality of location holes 166 may be provided which are drilled through and dowels located through the template into the surface therebeneath to retain the template in a substantially fixed location while the U-bolt hoes are drilled. These holes may be omitted if the template is used with the paint method simply to mark the hole locations and the template is removed before the holes are drilled.

With reference to FIGS. 4 to 8 and FIGS. 11 to 13 an embodiment of a method of assembling a surface mount barrier post retaining system, and a security barrier is described. At step S101 a post retaining element 102, front and rear traverse members 122, 126, left and right side members 132, 144, a drilling template 162 as shown in FIG. 12, four long U-bolts 130 and thirteen shorter U-bolts are provided as a kit of parts.

At step S102 the drilling template 162 is located in the required position and holes drilled in the marked places. This may either be done by drilling through the holes in the template with the template in place, or by spraying paint through the holes in the template, removing the template and then drilling the holes at locations marked by the paint The holes are drilled over size, for example using a 25 mm drill bit, for receiving the U-bolts.

Once the holes are drilled at step S103 the parts are assembled as follows. The post retaining element 102 is placed on a hard durable surface 138, for example on a concrete floor of a parking structure, in the location in which it is desired to install the system.

The front traverse member 122 is placed so that the formation in its middle passes over the foot box 108 and the left and right members 132, 134 are located so their central formations pass over the front traverse member 122, and the rear traverse member is then located in the recess 114 in the support plates 112 such that it passes over the left and right members 132, 133. For ease of assembly the different components may be numbered so that when assembled in numerical order they tessellate in the desired manner.

Figure 4:
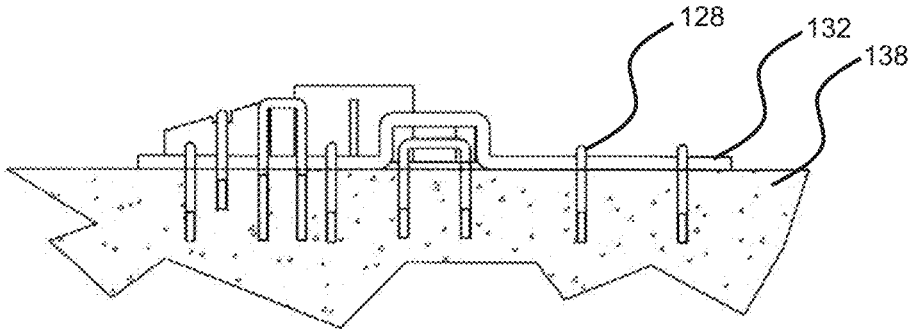
FIG. 4 shows a side view of an installed surface mount barrier post retaining system.

At step S104 the holes are filled with a cross-linking compound and at step S105 the U-bolts inserted. The cross linking compound could be, for example, a concrete or grout based product or a bolt setting compound, for example Vitrobond® from Atlas Minerals and Chemicals, Inc. It will be appreciated that any material of suitable strength and adhesion to the surface in which the U-bolts are set may be used. FIG. 4 shows the kit of parts installed in a surface 138.

In order to facilitate correct positioning of the holes, and therefore of the U-bolts, the members 122, 126, 132, 134 may be marked at the locations adjacent which the holes should be drilled. In the exemplary embodiment the positions outer U-bolts are located on the rear traverse member 126 with a separation of 100 mm from either end and inner U-bolts are positioned at a separation of 200 mm inward from the outer U-bolts; the positions outer U-bolts are located on the front traverse member 122 with a separation of 50 from either end and inner U-bolts are positioned at a separation of 250 mm inward from the outer U-bolts; and the positions outer U-bolts are located on the left and right traverse members 132, 134 with a separation of 100 mm from either end and inner U-bolts are positioned at a separation of 200 mm inward from the outer U-bolts at the impact facing end and at 300 mm inward from the outer U-bolts at the opposite end.

Figure 5:
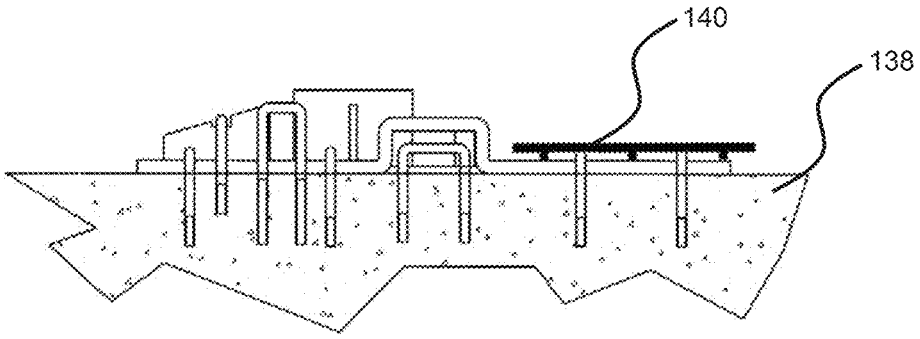
FIG. 5 shows the side view of FIG. 4 with rebar reinforcement located in place.
Figure 6:
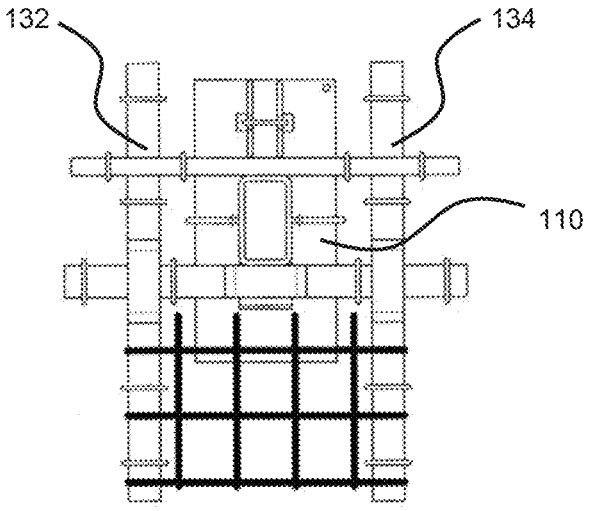
FIG. 6 shows a top view of FIG. 5.

Referring now to FIGS. 5 and 6, once the kit of parts is installed, in step S106 a rebar reinforcement grid 140 is placed over the impact facing part of the bottom plate 110 so that it extends between the left and right side members 132, 134. It will be appreciated that the rebar could, of course, be located prior to the U-bolts being set into the surface 138. It will be appreciated that the rebar reinforcement may be provided as a component of the kit of parts or may be provided separately or constructed on site. In the exemplary embodiment the rebar grid may comprise three 800 mm lengths of 16 mm diameter steel reinforcement bar (known in the art as rebar) and four 500 mm lengths of 16 mm diameter rebar. The three 800 mm lengths are arranged parallel to one another at approximately 170 mm centres and the 500 mm lengths are arranged perpendicular to the 800 mm lengths at 150 mm centres.

Figure 7:
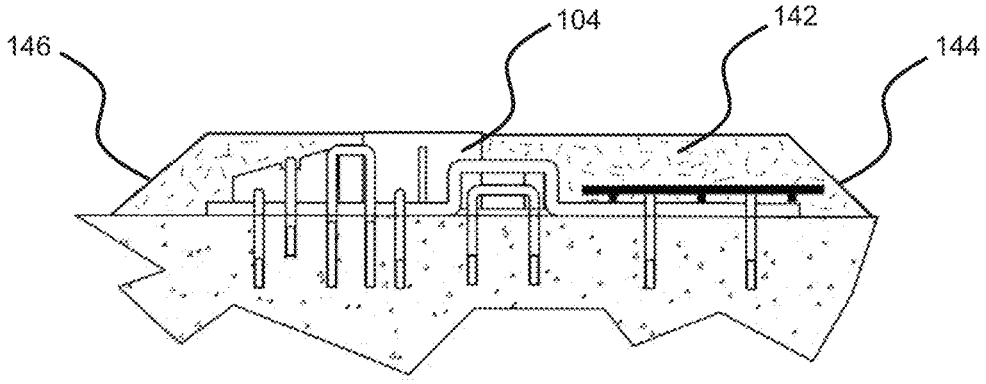
FIG. 7 shows the side view of FIG. 5 embedded in a concrete surround.
Figure 8:
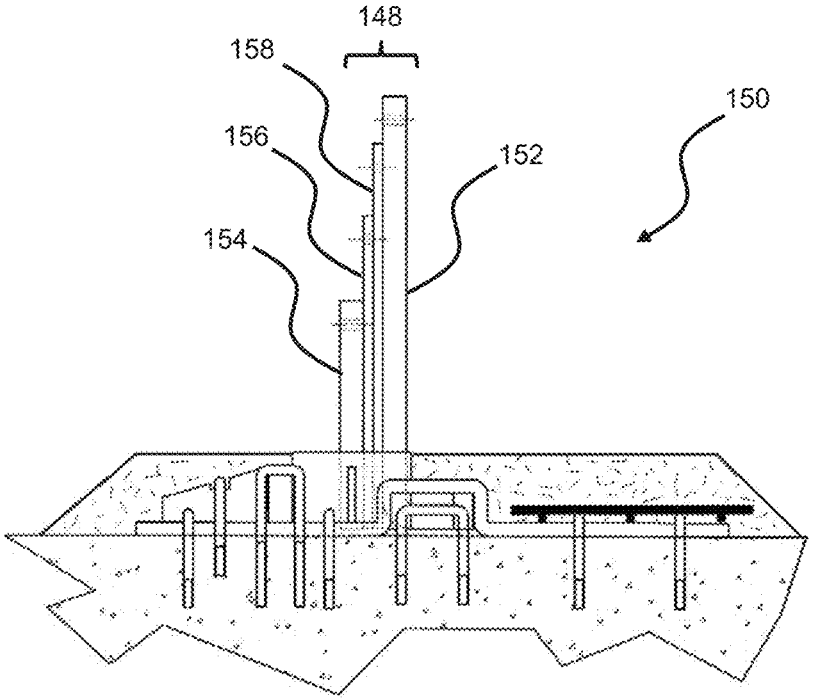
FIG. 8 shows a side view of a surface mount security barrier according to an embodiment having a multiple member impact post.

Referring to FIG. 7, at step S107 the assembled kit of parts, including the rebar grid 140 is then enclosed in concrete 142 up to a level just below the upper edge of the vertical hollow steel section 104. The concrete may be provided with a ramped edge 144, 146 at either side so as to reduce trip hazard. The concrete 142 may be provided by assembling shuttering, for example wood panels, to form a mould into which the concrete can be poured as is known in the art. At this stage the surface mount barrier post retaining system 102 is considered to be fully installed.

Due to the clearance provided therebetween, the concrete will fill the spaces between the U-bolts and the members and bottom plate over which they are located. Likewise as the holes 120 in the bottom plate 110 are elongate concrete will fill the space between the U-bolt legs and the sides of the holes 120.

Under impact the concrete in these regions will spread the load from the impact into the U-bolts. As the concrete will undergo some crushing, the duration of the impact is increased, i.e. the impact load is spread over a longer time period due to some movement as the concrete crushes, thereby reducing maximum instantaneous force. Even if the peak impact force is spread over a time period that is extended by a very short time period, this can have a significant effect on peak loading. In addition, as the front and rear traverse members, which are subject to significant loading are not immediately adjacent the surface on which the system is mounted (as they sit on top of the bottom plate which has a thickness) the forces acing on both legs of each U-bolt is a bending moment as opposed to a planar shear force as the force acts at a position offset from attachment of the U-bolts into the surface. In addition the provisions of the slots 120, which are elongate in the direction of impact, for receiving the U-bolt 128 in the bottom plate 110, under impact, as the bottom plate does not directly abut the U-bolts, shear force imparted on the bolts at the instant of impact is reduced or substantially eliminated. These above factors, combined with the use of a spring steel front and rear member which again act as energy absorbing elements and help transfer the energy of impact into the surface 138 in which the U-bolts are set.

Figure 9:
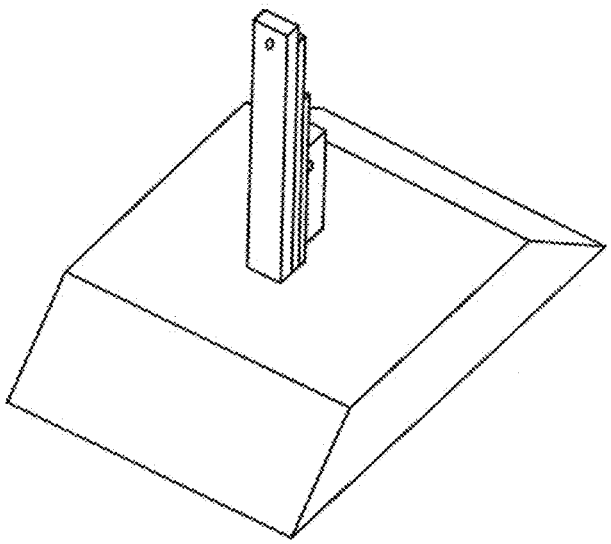
FIG. 9 shows a perspective view of the surface mount security barrier of FIG. 8.
Figure 10:
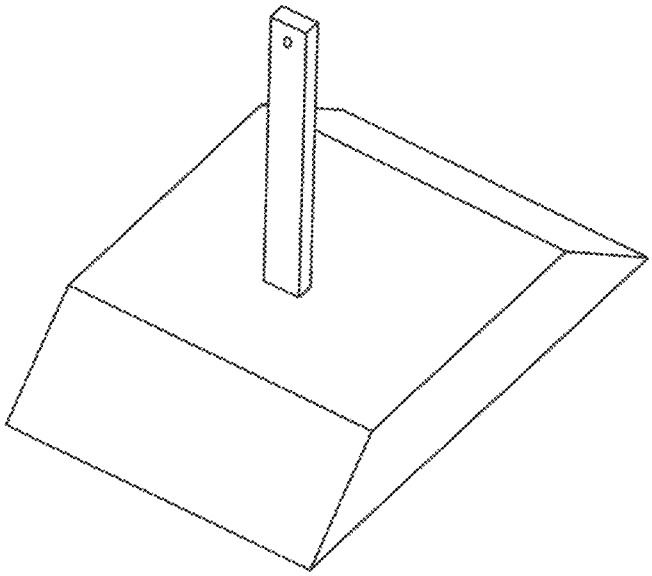
FIG. 10 shows a perspective view of a surface mount security barrier according to an embodiment having a single member impact post.

Once the concrete 142 is set the method can continue to form a security barrier. At step S108 an impact post 148 is located into the vertical hollow steel section 104 so as to form a security barrier 150. The post 148 consists of a first spring steel element 152 comprising a substantially vertical section and a substantially horizontal section. The element 152 is lowered into the vertical hollow steel section 104 and slid forwards such that the horizontal section thereof extends into the toe box 108 of the post retaining element 102. At step S109 subsequent spring steel elements 154, 156, 158 may be located behind the first element 152 to form a multi-layered post. It will be appreciated that the post 148 may comprise only the first spring steel element, 152, or may comprises a plurality of elements. The number and dimension of the elements can be selected to form a post of commensurate strength to the perceived impact against which the barrier 150 is designed to protect. FIGS. 9 and 10 show a security barrier having a multi element post and a security barrier having a single element post respectively.

Finally at step S110, a packing element (not shown) which may be a piece of steel (there is no need for this component to be spring steel although it may be if desired) is placed in the vertical hollow steel section 104 to fill the space behind the post elements 152, 154, 156, 158. This packing element is dimension to substantially extend between the rear interior face of the vertical hollow steel section 104 and the opposing face of the closest post element so as to retain the post elements 152, 154, 156, 158 in a position with the horizontal section of the first spring steel element 152 of the post 148 extending into the foot box 108. This prevents the post 148 from being ripped from the post retaining element 102 on impact.

The kit of parts described above may further comprise the impact post 148 described above and the packing element so as to form a kit of parts for a security barrier.

The security post may, once assembled be covered by a decorative shroud to increase its aesthetic appearance.

As described above, if, after installation, there is a requirement for vehicular access past then the installation of the barrier post into the retaining system can be reversed. First the packing element can be removed. Subsequently any subsequent spring steel elements 154, 156, 158 located behind the first spring steel element are removed (if present) and finally the first spring steel element 152 is slid backwards so that the horizontal section thereof exits the toe box 108 of the post retaining element 102, after which it can be lifted vertically out of the retaining system 100. As will be appreciated the retaining system, shrouded in concrete (as shown in FIG. 7) will remain firmly affixed to the surface on which it is installed and a vehicle may then pass over the retaining system to gain access past the barrier. As the retaining system remains in place, it effectively creates "speed-bumps" that will allow slow passage over a vehicle thereover.

The barrier described herein has been tested in accordance with BSI IWA 14-1 for vehicle security barriers and met the requirements of the test in a collision with a 7 ton (7,000 kg) truck travelling at 30 mph (48.3 km/h). The bollard described herein is the worlds first surface mount bollard to pass this test furthermore is the first single removable bollard to pass this test.

It will be appreciated that the dimensions of the parts of the system given herein are illustrative examples of one embodiment and that the dimensions may vary without departing from the scope of the disclosure, in particular it will be appreciated that the dimensions will be dependent upon the maximum impact force that the barrier is designed to withstand, and that even for a single maximum impact force different dimensions may be possible. It will be appreciated that various changes and modifications can be made to the present disclosure without departing from the scope of the present application.

The invention claimed is:

1. A surface mount retaining system for a barrier post, the retaining system comprising:

a post retaining element for receiving said barrier post, the post retaining element comprising a substantially vertical hollow steel section having an opening at its lower end on a first side thereof, a steel foot box aligned with said opening and extending therefrom in a first direction, and a bottom plate to which said hollow steel section and said foot box are attached;

a steel front traverse member formed to pass over the steel foot box and lie adjacent to the bottom plate substantially perpendicular to said first direction on either side of said steel foot box;

a steel rear traverse member that lies adjacent to the vertical hollow steel section on a second side thereof opposite said first side, and substantially perpendicular to said first direction; wherein the front traverse member and the rear traverse member extend to the lateral sides of the substantially vertical hollow steel section; and a plurality of U-bolts, said U-bolts arranged to pass over said front and rear traverse members on either side of said post retaining element to, in use, be received and set into a plurality of holes drilled into a surface on which said barrier post retaining system is mounted.

2. The system of claim 1 wherein the front and rear traverse members are spring steel members.

3. The system of claim 1 further comprising at least one support plate extending substantially vertically from the bottom plate and abutting a rear facing side of said vertical hollow section, each said at least one support plate having a recess in its upper edge for receiving said rear traverse member therein and when located in said recess in said at least one support plate, the rear traverse member is maintained in spaced relation from said bottom plate.

4. The system of claim 3 wherein said bottom plate comprises two openings therein, the system further comprising a U-bolt passing over said at least one support plate and through said openings in said bottom plate to, in use, be received and set into holes drilled into said surface on which the barrier post retaining system is mounted, and wherein said openings in said bottom plate are elongate in said first direction.

5. The system of claim 1 further comprising:

at least one left and at least one right spring steel member each extending, in use, along the surface on which the system is mounted, each of the left and right members passing beneath said rear member and passing over said front member substantially perpendicular thereto in a position offset to the left and the right of said bottom plate respectively, wherein said plurality of U-bolts are further arranged to pass over said left and right spring steel members at or adjacent either end thereof to, in use, be received and set into said plurality of holes.

6. The system of claim 1 wherein the internal width of each said U-bolt is greater than the external dimension of the member over which they pass such that there is a clearance therebetween.

7. The system of claim 1 further comprising a concrete surface on which the system is mounted, the concrete surface having a plurality of holes therein in which said U-bolts are retained and set using a cross-linking compound.

8. The system according to claim 7 further comprising a concrete encapsulation that covers said retaining element substantially up to the top of said vertical hollow steel section, said traverse members, and said plurality of U-bolts.

9. A security barrier comprising:

a surface mount barrier post retaining system according to any preceding claim;

a barrier post extending into said vertical hollow steel section and comprising at least a first spring steel element comprising a substantially vertical section and a substantially horizontal section; and at least one packing element, wherein said at least one packing element is located in said vertical hollow steel section behind said barrier post to retain it in a position in which said horizontal section thereof extends into said foot box.

10. The security barrier according to claim 9 wherein the barrier post further comprises at least one further vertical spring steel section adjacent said first spring steel element, said further spring steel section having one end thereof extending into the vertical hollow section between said first spring steel element and said packing element.

11. A kit of parts for a surface mount barrier post retaining system, the kit of parts comprising:

a post retaining element for receiving an barrier post, the post retaining element comprising a substantially vertical hollow steel section having an opening at its lower end on a first side thereof, a steel foot box aligned with said opening and extending therefrom in a first direction, and a bottom plate to which said hollow steel section and said foot box are attached;

a first elongate steel member having a formation therein to, when assembled, pass over said steel foot box and lie adjacent to the bottom plate substantially perpendicular to said first direction on either side of said steel foot box and extend to the lateral sides of the substantially vertical hollow steel section;

a second elongate steel member which lies adjacent to the vertical hollow steel section on a second side thereof opposite said first side, and substantially perpendicular to said first direction and extend to the lateral sides of the substantially vertical hollow steel section; and a plurality of U-bolts dimensioned to, on assembly, pass over said front and rear traverse members on either side of said post retaining element.

12. The kit of parts according to claim 11 wherein said first and second elongate steel members comprise spring steel.

13. The kit of parts according to claim 11 wherein said post retaining element further comprises at least one support plate extending substantially vertically from said bottom plate and abutting a rear facing side of the vertical hollow section, each said at least one support plate having a recess in its upper edge for, on assembly, receiving said rear traverse member therein and wherein said bottom plate comprises two openings therein for, on assembly, receiving a further U-bolt passing over said at least one support plate and through said openings, and wherein said openings are elongate in the first direction.

14. The kit of parts according to claim 11 comprising:

two further spring steel members which on assembly extend along the surface on which the system is mounted, each of said two further spring steel members passing beneath the second elongate member and shaped to pass over the first elongate member substantially perpendicular thereto in a position offset from the bottom plate; and a plurality of U-bolts for on assembly passing over one of said two further spring steel members at or adjacent either end thereof.

15. The kit of parts according to claim 11 further comprising a drilling template comprising a planar template having drilling locations thereon.

16. A kit of parts according to claim 11 further comprising:

a barrier post comprising at least a first spring steel element comprising a substantially vertical section and a substantially horizontal section, which on assembly extends into said vertical hollow steel section, and at least one packing element.

17. A method of constructing a surface mount barrier post retaining system comprising:

drilling a plurality of holes in said concrete surface ;

assembling a surface mount barrier post retaining system comprising:

a post retaining element for receiving said barrier post, the post retaining element comprising a substantially vertical hollow steel section having an opening at its lower end on a first side thereof; a steel foot box aligned with said opening and extending therefrom in a first direction; and a bottom plate to which said hollow steel section and said foot box are attached; a steel front traverse member formed to pass over the steel foot box and lie adjacent to the bottom plate substantially perpendicular to said first direction on either side of said steel foot box; and a steel rear traverse member that lies adjacent to the vertical hollow steel section on a second side thereof opposite said first side, and substantially perpendicular to said first direction; wherein the front traverse member and the rear traverse member extend to the lateral sides of the substantially vertical hollow steel section on a concrete surface such that the traverse members are adjacent and between drilled holes;

locating a plurality of U-bolts such that they pass over the front and rear traverse members on either side of the post retaining element and into said drilled holes and securing said u bolts in said holes using one of grout, a concrete or a bolt setting compound.

18. A method according to claim 17 further comprising encapsulating said retaining element, said vertical hollow steel section, said traverse members, and said plurality of U-bolts in concrete substantially up to the top of said vertical hollow section.

19. A method according to claim 17 further comprising:

locating a spring steel barrier post such that it extends into said vertical hollow steel section, said barrier post having a substantially vertical section and a substantially horizontal section, and locating at least one packing element in said vertical hollow steel section behind said barrier post to retain it in a position in which said horizontal section thereof extends into said foot box.

20. A method according to claim 19 further comprising: locating at least one further vertical spring steel section adjacent said spring steel barrier post such that one end of said vertical further spring steel section extends into said vertical hollow section between said first spring steel element and said packing element.

* * * * *